US011213741B2

(12) United States Patent
Duprey

(10) Patent No.: US 11,213,741 B2
(45) Date of Patent: Jan. 4, 2022

(54) BOARD GAME

(71) Applicant: QT3.14 LLC, Potsdam, NY (US)

(72) Inventor: Becky Duprey, Ogdensburg, NY (US)

(73) Assignee: QT3.14 LLC, Potsdam, NY (US)

( * ) Notice: Subject to any disclaimer, the term of this patent is extended or adjusted under 35 U.S.C. 154(b) by 266 days.

(21) Appl. No.: 15/816,710

(22) Filed: Nov. 17, 2017

(65) Prior Publication Data

US 2018/0154248 A1 Jun. 7, 2018

Related U.S. Application Data

(60) Provisional application No. 62/431,035, filed on Dec. 7, 2016.

(51) Int. Cl.

| | |
|---|---|
| ***A63F 3/04*** | (2006.01) |
| ***A63F 11/00*** | (2006.01) |
| ***A63F 3/00*** | (2006.01) |

(52) U.S. Cl.

CPC ..... *A63F 3/0415* (2013.01); *A63F 11/0074* (2013.01); *A63F 2003/00996* (2013.01); *A63F 2003/0418* (2013.01); *A63F 2011/0079* (2013.01); *A63F 2011/0086* (2013.01)

(58) Field of Classification Search

CPC ..... A63F 3/0415; A63F 11/0074; A63F 2003/00996; A63F 2003/0418

See application file for complete search history.

(56) References Cited

U.S. PATENT DOCUMENTS

| | | | | |
|---|---|---|---|---|
| 2,320,832 A * | 6/1943 | Schoenberg | A63F 3/0415 273/242 |
| 2,750,193 A * | 6/1956 | Wales | A63F 3/00176 273/236 |
| 2,752,158 A * | 6/1956 | Brunot | A63F 3/0415 273/272 |
| 3,396,972 A * | 8/1968 | Smith | A63F 3/0423 273/141 R |
| 3,460,835 A | 8/1969 | Crans | |

(Continued)

FOREIGN PATENT DOCUMENTS

| | | |
|---|---|---|
| CH | 684243 | 8/1994 |
| WO | WO2007056965 | 5/2007 |

OTHER PUBLICATIONS

Mathable (2 pages).*

*Primary Examiner* — Michael D Dennis
(74) *Attorney, Agent, or Firm* — Woods Oviatt Gilman LLP; Dennis B Danella, Esq.; Douglas R. Smith, Esq.

(57) ABSTRACT

A method of playing a board game includes a game board arranged as a grid. The board is set up before play where certain playing squares include first or second indicia such that respective numbered tiles with matching indicia may be randomly placed on the certain playing squares. Players may then perform a series turns placing tiles having a third indicia on the board in a single straight line using at least one of the numbered tiles already placed on the board. The tiles must create one or more linear sequences wherein the sum of the numbered tiles within each linear sequence equals a predetermined value. Points are awarded to the player based at least in part on the number of linear sequences created during the turn. The winner may be the player with the highest total awarded points at the end of the game. Other aspects are also provided.

6 Claims, 6 Drawing Sheets

(56) References Cited

U.S. PATENT DOCUMENTS

| | | | | | |
|---|---|---|---|---|---|
| 3,844,568 | A * | 10/1974 | Armstrong | A63F 3/04 | 273/272 |
| 3,904,207 | A * | 9/1975 | Gold | A63F 3/0415 | 273/272 |
| 4,243,225 | A * | 1/1981 | Levinrad | A63F 3/0423 | 273/272 |
| 4,283,058 | A * | 8/1981 | de Cadier | A63F 3/0415 | 273/236 |
| 4,565,374 | A * | 1/1986 | Pak | A63F 3/0415 | 273/272 |
| 5,314,190 | A | 5/1994 | Lyons | | |
| 5,338,203 | A * | 8/1994 | Rheams | G09B 1/04 | 273/272 |
| 5,893,718 | A | 4/1999 | O'Donnell | | |
| 6,508,468 | B1 | 1/2003 | Challice | | |
| 8,251,367 | B2 * | 8/2012 | Yu | A63F 3/00643 | 273/272 |
| 2006/0043677 | A1 * | 3/2006 | McElvaney | A63F 3/04 | 273/264 |
| 2007/0063437 | A1 * | 3/2007 | Hyra | A63F 3/04 | 273/272 |
| 2008/0252008 | A1 | 10/2008 | Harden | | |
| 2016/0296835 | A1 * | 10/2016 | Cunningham | A63F 9/20 | |

* cited by examiner

BOARD GAME

CROSS-REFERENCE TO RELATED APPLICATIONS

This application claims the benefit of U.S. Provisional Patent Application No. 62/431,035, filed Dec. 7, 2016, entitled SUM OF WHICH, the entirety of which is incorporated herein by reference.

FIELD OF THE INVENTION

The present invention relates to a board game; in particular, a mathematics-based board game; and more particularly to a mathematics-based board game where players are awarded points for placing numbered game tiles on the game board to make a predetermined value.

BACKGROUND OF THE INVENTION

Tile sequencing games are known in the art. A popular and well-known the sequencing game is SCRABBLE where players arrange lettered tiles to form words. This concept has been extended to mathematics-based the sequencing games where players arrange tiles to perform specific operations or to add up to a specified number or multiple of that number. However, these games use a standardized, fixed game board with randomness created solely through players drawing random tiles during game play.

Therefore, there is a need for a tile sequencing board game wherein the game board is randomized before the start of each game through placement of randomly selected set-up tiles prior to the beginning of each new game. The present invention addresses these as well as other needs.

BRIEF SUMMARY OF THE INVENTION

It is, therefore, an aspect of the present invention to provide a method of playing a board game having at least two players. The board game may comprise a game board arranged as a grid of a plurality of playing squares. The plurality of playing squares may include a first set of playing squares having a first indicia, a second set of playing squares having a second indicia, and a third set of playing squares having a third indicia. A first set of numbered tiles may have the first indicia, a second set of numbered tiles may have the second indicia, and a third set of numbered tiles may have the third indicia. The method may comprise: A) placing a respective number of numbered tiles from the first set of numbered tiles on each playing square in the first set of playing squares; B) placing a respective number of numbered tiles from the second set of numbered tiles on each playing square in the second set of playing squares; C) placing the third set of numbered tiles in a draw pool; D) each of the at least two players removing a predetermined number of numbered tiles from the draw pool to form respective player pools; E) performing a series of successive player turns where each of the at least two players sequentially takes a turn, wherein the player taking a current turn either: i) passes on the current turn to a next successive player, wherein the next successive player is one of the at least two players, or ii) plays the current turn by: a) selecting one or more numbered tiles from the player pool of the player taking the current turn; and either: i) placing the selected one or more numbered tiles on the game board adjacent to at least one of the first set, the second set, or the third set of numbered tiles already placed on the game board in at least one of a straight vertical line or a straight horizontal line including at least one of the first set, the second set, or the third set of numbered tiles already placed on the game board, wherein the placed one or more numbered tiles creates one or more linear sequences, and wherein a sum of the numbers on the numbered tiles within each of the one or more linear sequences equals a predetermined value, or ii) placing the selected one or more tiles in the draw pool; b) awarding points to the player taking the current turn based at least in part on a number of linear sequences created during the current turn; and c) replacing from the draw pool a number of replacement numbered tiles equal to a number of the selected one or more numbered tiles played from the player pool during the current turn, F) continuing the series of successive player turns until the occurrence of an end of game event; and G) determining a winner following the end of game event, wherein the winner is one of the at least two players.

In a further aspect of the present invention, the end of game event occurs when the draw pool is empty of numbered tiles of the third set of numbered tiles and one of the at least two players has placed all of the numbered tiles in their respective player pool on the game board. Determining a winner is based on the player having the highest total of awarded points following the end of the game event.

In still another aspect of the present invention, the plurality of playing squares further includes a bonus set of playing squares having a bonus indicia, wherein the method further comprises awarding points if the selected one or more numbered tiles placed on the game board in the current turn is located on at least one of the bonus set of playing squares.

In a further aspect of the present invention, the game board may further include a fourth set of playing squares having a fourth indicia, and wherein the board game further includes a fourth set of numbered tiles having the fourth indicia. The method may further comprise: placing a number of respective numbered tiles from the fourth set numbered tiles on each playing square in the fourth set of playing squares before the step of performing a series of successive player turns.

In still another aspect of the present invention, one or more of the numbered tiles in the first set, the second set, the third set, and the fourth set of numbered tiles may further include an image of a ten frame thereon. Each of the numbered may include an image of an integer, a decimal, a fraction or combinations thereof.

In another aspect, the present invention may provide for a board game comprising a game board arranged as a grid of a plurality of playing squares, wherein the plurality of playing squares includes a first set of playing squares having a first indicia, a second set of playing squares having a second indicia, and a third set of playing squares having a third indicia. The board game may further include: a first set of numbered tiles having the first indicia, wherein at least one of the first set of numbered tiles are configured to be placed in the first set of playing squares; a second set of numbered tiles having the second indicia, wherein at least one of the second set of numbered tiles are configured to be placed in the second set of playing squares; and a third set of numbered tiles having the third indicia, wherein the third set of numbered tiles are configured to be placed in a draw pool, wherein a predetermined number of the third set of numbered tiles are configured to be selectively removed from the draw pool and placed in two or more player pools. The third set of numbered tiles in the player pools are configured to be selectively placed on the third set of playing squares adjacent to at least one of the first set, the second set, or the third set of numbered tiles already placed on the game board in at least one of a straight vertical line or a straight horizontal line including at least one of the first set, the second set, or the third set of numbered tiles already placed on the game board. The placed one or more numbered tiles are configured to create one or more linear sequences so that a sum of the numbers on the numbered tiles within each of the one or more linear sequences equals a predetermined value.

Additional aspects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
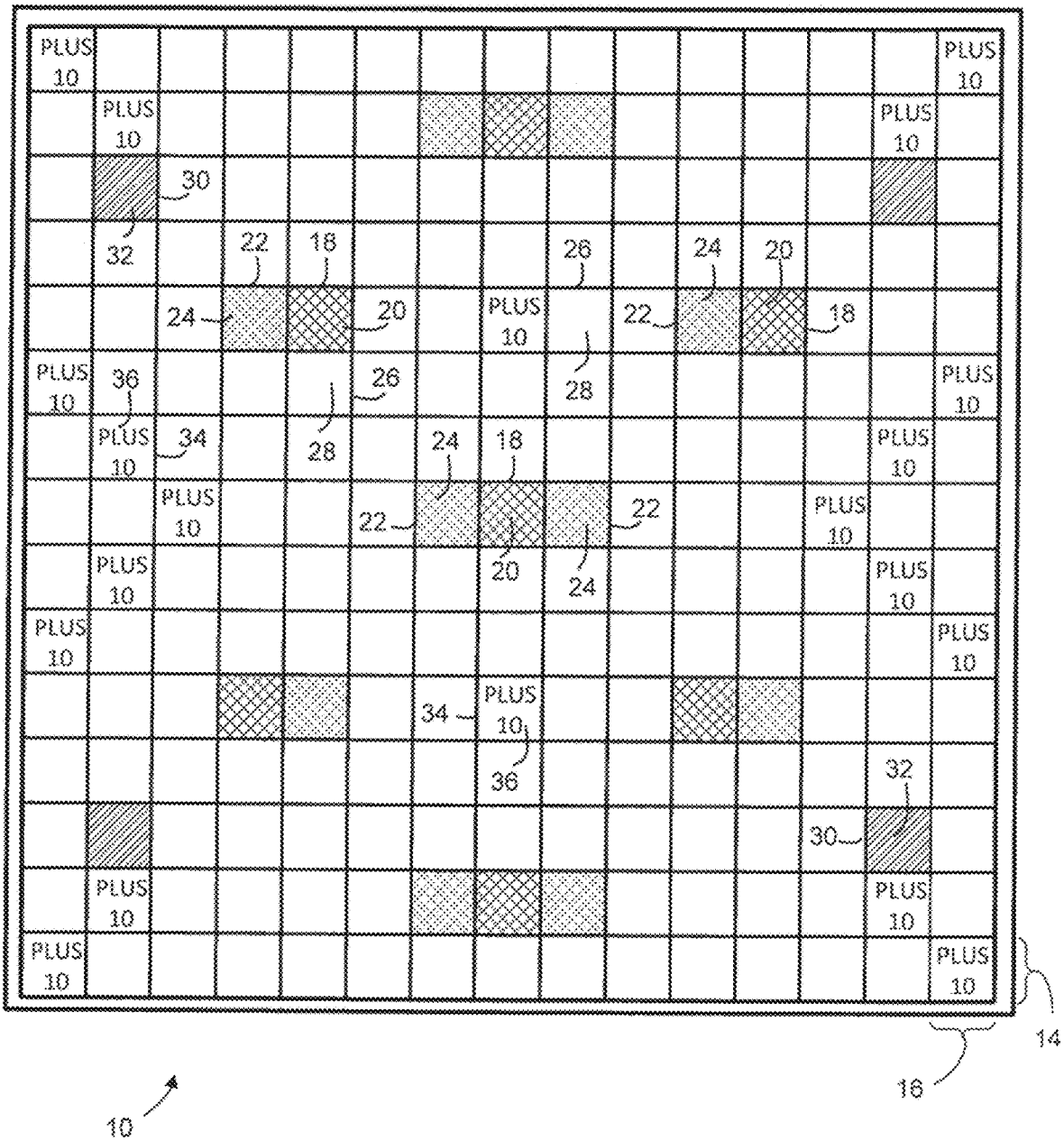
FIG. 1 is a top plan view of an exemplary game board suitable for use within a method of playing a board game in accordance with an aspect of the present invention.
Figure 2A:
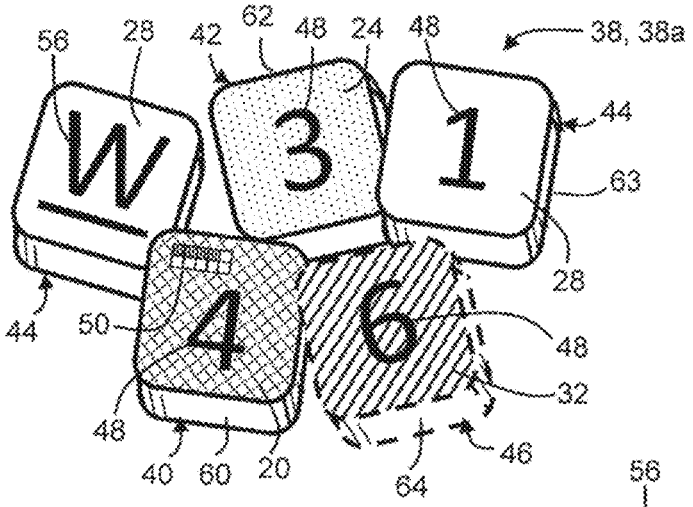
FIG. 2A is perspective view of an exemplary game tiles that may be used in conjunction with the board game shown in FIG. 1 in one game scenario.
Figure 2B:
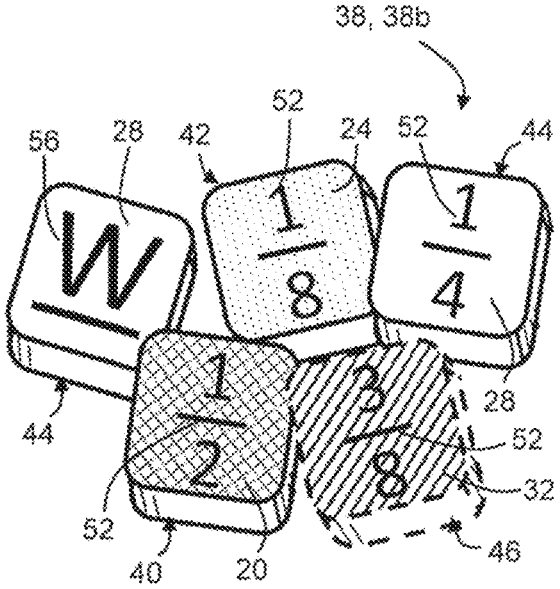
FIG. 2B is perspective view of other exemplary game tiles that may be used in conjunction with the board game shown in FIG. 1 in another game scenario.
Figure 2C:
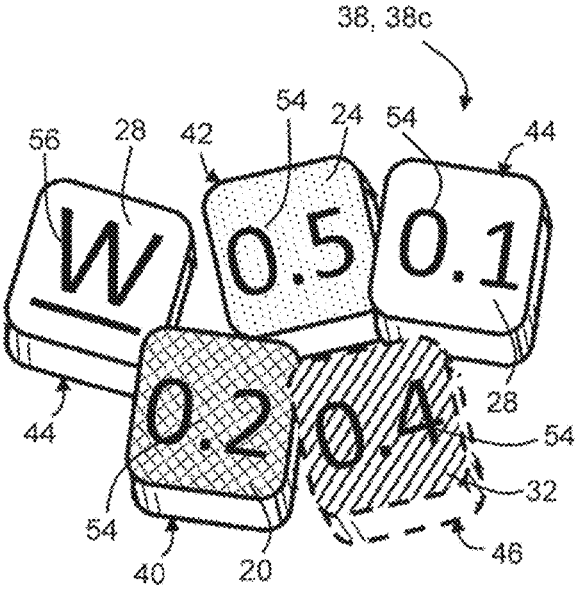
FIG. 2C is perspective view of other exemplary game tiles that may be used in conjunction with the board game shown in FIG. 1 in yet another game scenario.
Figure 3:
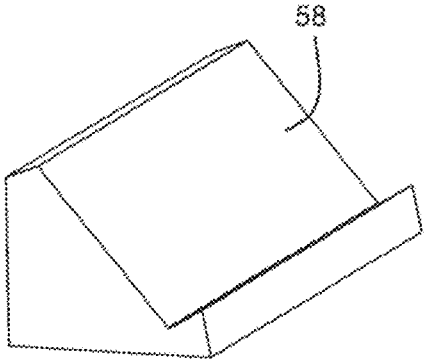
FIG. 3 is a perspective view of an optional the rack configured to receive one or more of the game tiles shown in FIG. 2 before the game tiles are placed on the game board.

With reference to FIGS. 1 through 3, there is shown an exemplary board game system adapted to perform a method of playing a board game in accordance with the present invention. As seen in FIG. 1, the exemplary board game system may include a game board 10 arranged as a grid of a plurality of individual playing squares 12. Each square 12 may be one square within a horizontal row of squares 14 and a vertical column of squares 16. A first set 18 of playing squares 12 may include a first indicia 20 while a second set 22 of playing squares 12 may include a second indicia 24. A third set 26 of all remaining squares 12 may include a third indicia 28. In accordance with an aspect of the present invention, an optional fourth set 30 of certain playing squares 12 may include a fourth indicia 32. In accordance with still another aspect of the present invention, a certain subset 34 of squares 12 may also include a bonus indicia 36 denoting each square 12 within the subset 34 as a bonus square, as will be discussed in greater detail below. It should be understood that the indicia discussed herein may take any form including, but not limited to, a symbol (e.g., cross-hatch lines, diagonal lines, dots, etc.), text, number, and/or color.

Turning now to FIG. 2A, the exemplary board game system may include various sets of numbered tiles 38, wherein each tile 38 may be proportioned to substantially fill the delineated space that defines a single square 12. That is, each tile 38 may be defined by a perimeter that is equal to or slightly less than the perimeter of square 12 such that each tile 38 may be positioned within square 12 without overlapping any adjacent square(s). In accordance with one aspect of the present invention, one game scenario may comprise numbered tiles 38*a* including a first set 40 of numbered tiles 38*a* including first indicia 20, a second set 42 of numbered tiles 38*a* including second indicia 24, and a third set 44 of numbered tiles 38*a* including third indicia 28. In accordance with another aspect, another game scenario may comprise an optional fourth set 46 of numbered tiles 38*a* including fourth indicia 32. Each of the numbered tiles 38*a* within the first set, second set, third set and fourth sets 40, 42, 44, 46 may include an image of an integer 48 as seen in FIG. 2A. Within each of first, second, third and fourth sets 40, 42, 44, 46, the integers 48 depicted on the respective tiles may all be different (i.e., there are no integers within a respective set that are duplicated), all the same (i.e., all of the integers within a respective set are the same), mixed where there are many different integers each being used once, and/or mixed where there are many different integers and at least one of the integers are duplicated at least once (i.e., there are many different integers used in a respective set, wherein there is more than one of the same integer(s) provided (for example, there may be three two's, two three's, and two four's in a respective set)). Further, one or more of the numbered tiles 38*a* within the first set, second set, third set and fourth sets 40, 42, 44, 46 may optionally include an image of a ten frame 50.

In accordance with another aspect of the present invention, as best seen in FIG. 2B, in another game scenario each of the numbered tiles 38*b* within the first set, second set, third set and fourth set 40, 42, 44, 46 may include an image of a fraction 52. In accordance with yet another aspect of the present invention, as best seen in FIG. 2C, in yet another game scenario each of the numbered tiles 38*c* within the first set, second set, third set and fourth set 40, 42, 44, 46 may include an image of a decimal 54. Moreover, in any of the game scenarios described above, a subset of third set 44 of the plurality of numbered tiles 38 may include a wildcard indicator 56, such as but not limited to the letter "W", whereby tile 38 having wildcard indicator 56 may be designated by a player to have any selected value that may not change during the course of the game, as will be discussed in greater detail below.

As shown in FIG. 3, the exemplary board game system may include a plurality of optional tiles racks 58 whereby each player may arrange his or her tiles 38 on a respective tile rack 58. Each respective tile rack 58 may assist a player in organizing the tiles 38 while also minimizing chances for opposing players to improperly view those tiles 38 before they are played on game board 10. Alternatively, in another aspect of the present invention, tile racks 58 may not be used and players may, instead, place their respective tiles face-up such that all players may view the tiles held by every other player. Accordingly, this alternative aspect of the invention may impart a further strategic element as a player is not only playing his or her own tiles, but anticipating plays made by the other players during their respective turns, as will be discussed in greater detail below.

Figure 4:
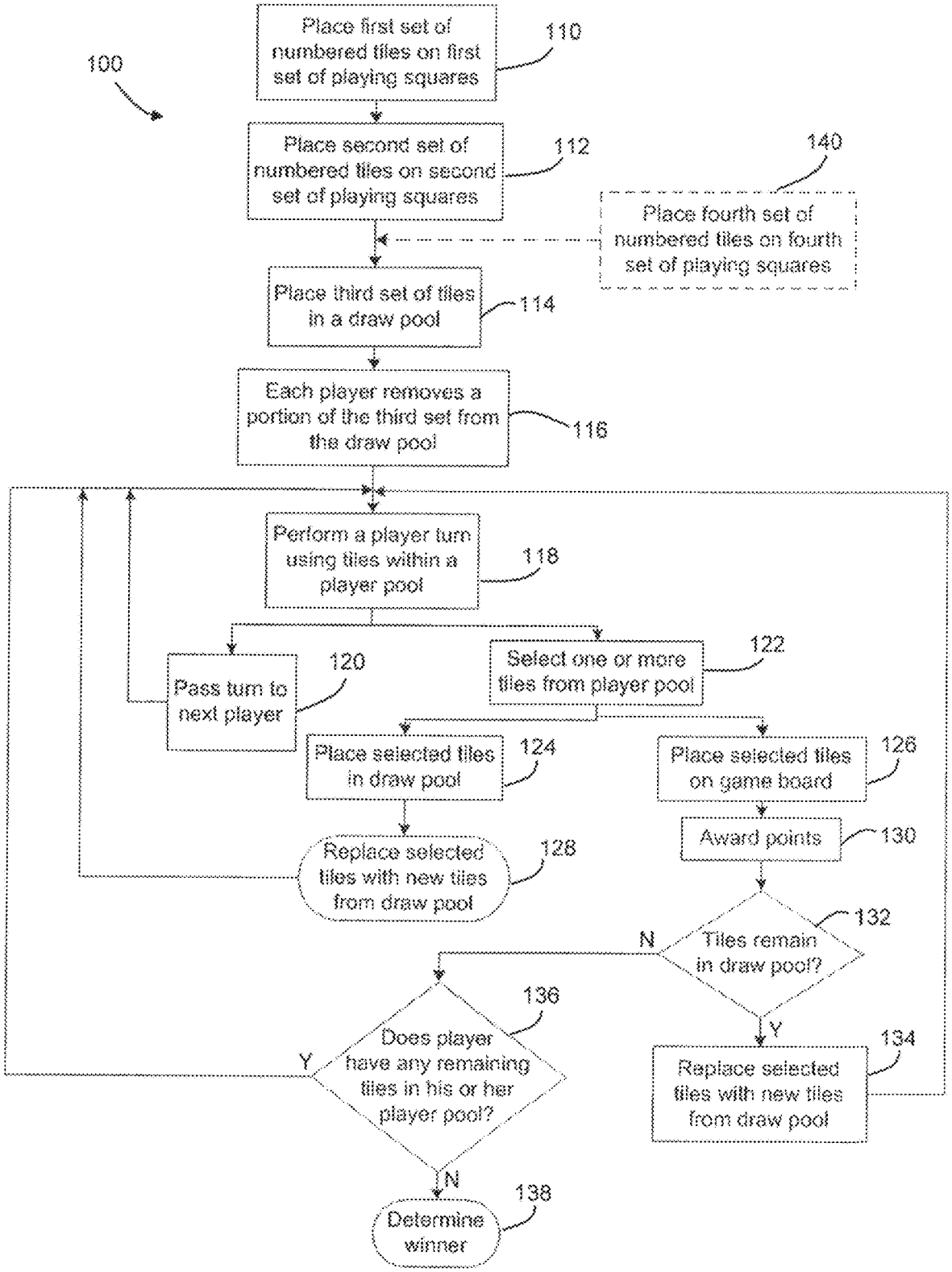
FIG. 4 is a flow chart of an exemplary method of playing a board in accordance with an aspect of the present invention.

Bearing in mind the above-referenced description of the exemplary board game system, and with reference to FIGS. 4 and 5, an exemplary method 100 of setting up and playing a game including two or more players will now be described using numbered tiles 38*a* that include an image of integer 48 thereon; however, it should be understood that method 100 may also be used in conjunction with numbered tiles 38*b* or 38*c*. For instance, method 100 may generally include setting up game board 10 by: a) placing numbered tiles 60 from first set 40 of the plurality of numbered tiles 38*a* on each respective playing square of first set 18 of playing squares 12 at step 110, wherein indicia 20 on the respective numbered tiles 60 and each respective playing square 12 from first set 18 correspond with one another; b) placing numbered tiles 62 from second set 22 of the plurality of numbered tiles 38*a* on each respective playing square of second set 22 of playing squares 12 at step 112, wherein indicia 24 on the respective numbered tiles 62 and each respective playing square 12 from second set 22 correspond with one another; and c) placing third set 44 of numbered tiles 38*a* in a draw pool adjacent to game board 10 at step 114.

With game board 10 so arranged, at step 116, each of the two or more players may then remove a predetermined number of third set 44 of numbered tiles 38*a* from the draw pool to form respective player pools. When playing a physical board game version, each player pool may be placed on a respective tile rack 58 for each player or placed face-up (integer 48, fraction 52, decimal 54, wildcard indicator 56 displayed) in front of each respective player, such as on the table top surface. In accordance with a further aspect of the invention, when playing an electronic version of the board game using a computing device, each player's tiles may only be viewed by those tile's owners with all other player's tiles obscured or all player's tiles may displayed for each player to view (see FIG. 7 and below discussion directed thereto). The players may then perform a series of successive player turns, wherein each of the two or more players sequentially takes a turn at step 118. During a turn, a respective player may either pass their turn to a next successive player at step 120, or play a turn by selecting one or more tiles from their respective player pool at step 122 and either: i) place the selected one or more tiles in the draw pool at step 124; or ii) place the selected one or more tiles on game board 10 adjacent to at least one of first set 40 and/or second set 42 and/or third set 44 of numbered tiles 38*a* that are already placed on game board 10 at step 126 to form a straight vertical or horizontal line.

At step 128, if the player elects to return selected tiles to the draw pool at step 124, then the player may take from the draw pool a number of replacement tiles equal to the number of selected one or more tiles played from their player pool at step 124. In accordance with an aspect of the present invention, the player electing to return and swap tiles may incur a penalty for each tile thus swapped by deducting a point value. At this point, the player's turn ends and the next successive player may then proceed with their respective turn.

However, if the selected tiles are placed on game board 10 at step 126, points are awarded to the player at step 130, as will be discussed in greater detail below. It must then be determined whether any tiles remain within the draw pool at step 132. If tiles do remain (Y), the player may then, at step 134, take from the draw pool a number of replacement tiles equal to the number of selected one or more tiles played from their player pool at step 126. At this point, the player's turn ends and the next successive play may then proceed with their turn.

Alternatively, if there are no longer any tiles within the draw pool (N), the player determines if there are any remaining tiles within his or her player pool at step 136. If the player has remaining tiles in their player pool (Y), the player's turn ends and the next successive player may then proceed with their turn. However, if the player no longer has any tiles (N), this will trigger an end of game event and a winner may be determined at step 138, wherein the player having the highest total number of awarded points is the winner. While an end of game event has been described as occurring when the draw pool is empty of replacement tiles and a player has used all of their tiles, it should be understood by those skilled in the art that other end of game events may be envisioned and employed, such as, but not limited to, when each player has at least one tile remaining in their respective player pool but no player is permitted to play a tile on the game board, playing until one player reaches a predetermined number of awarded points, or playing a game for a set length of time where a winner is declared once the allotted playing time has expired.

In an optional aspect of method 100, game board 10 may further include fourth set 30 of certain playing squares 12 and fourth set 46 of numbered tiles 38*a*, which both include fourth indicia 32. In this case, method 100 may further include an additional step 140 whereby a respective numbered tile 64 from fourth set 46 of numbered tiles 38*a* may be placed on each respective playing square of fourth set 30 of certain playing squares 12. Step 140 may be conducted prior to step 118 wherein the players perform a series of successive player turns, or alternatively, prior to each player removing a predetermined number of third set 44 of numbered tiles 38*a* from the draw pool to form respective player pools at step 116.

With the above description in mind, the following describes a non-limiting example of one possible board game system and method of playing same in accordance with the present invention.

Example 1

Figure 5:
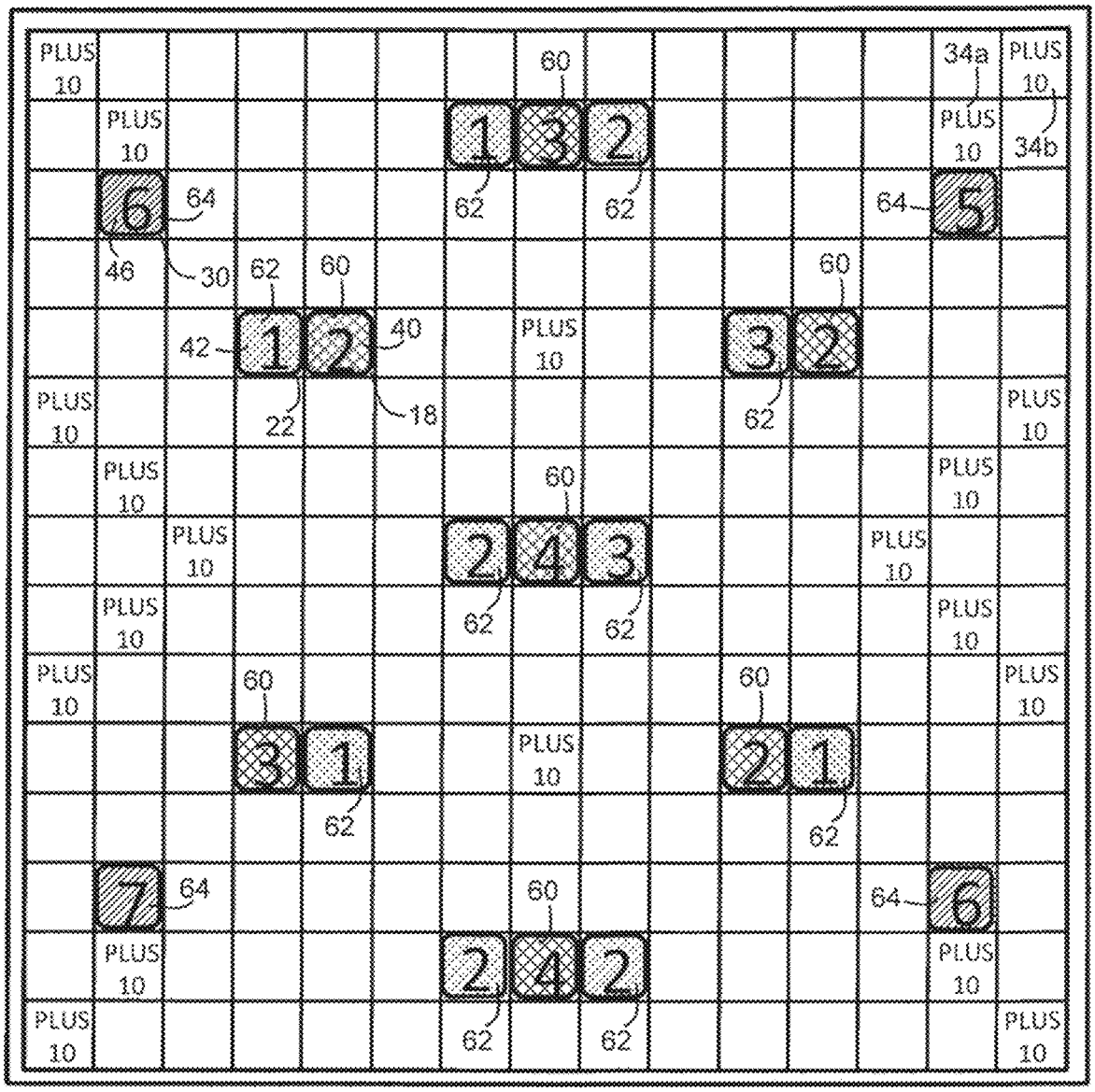
FIG. 5 is top plan view of the game board shown in FIG. 1, with an exemplary arrangement of pre-placed game tiles on respective playing squares in accordance with the method of playing a board game of the present invention.
Figure 6:
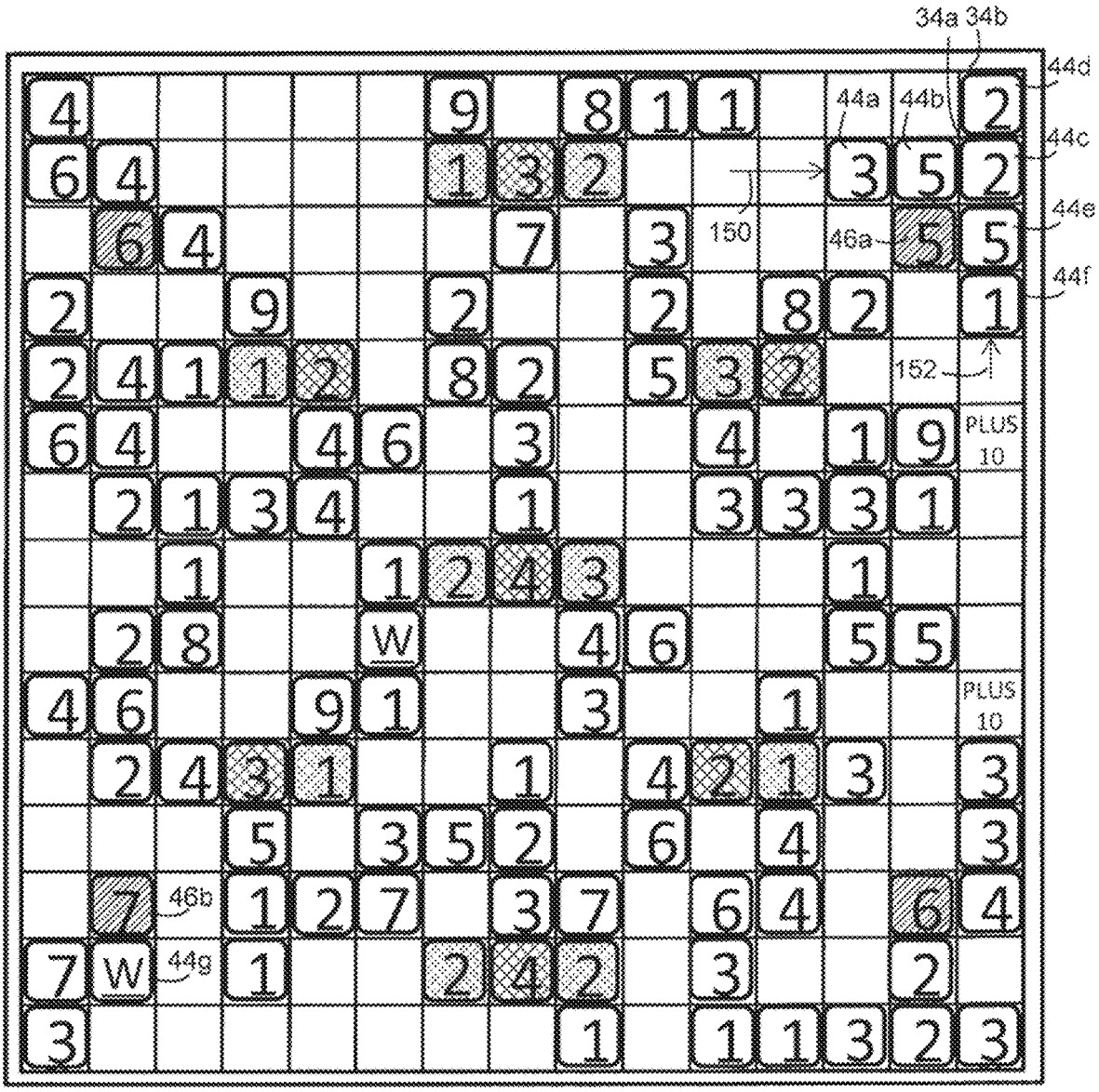
FIG. 6 is a top plan view of the game board shown in FIG. 4 at the completion of the exemplary game.

With reference to FIGS. 5 and 6, one example of a method of playing a board game in accordance with an aspect of the present invention requires each player to make one or more linear sequences of numbered tiles, wherein the numbers on the tiles sum to a predetermined value—the integer "10". Each player may use up to five tiles per turn and place one to five tiles in a single straight vertical or horizontal line or orientation. A player may then earn ten (10) points for each sum of "10" made in a linear sequence. In other words, in this example, ten (10) points may be awarded to the player taking the current turn for each linear sequence created during the current turn. In another aspect, three (3) points may additionally be awarded to the player for each tile played during the turn. Certain bonus squares 34 may also be utilized by players so as to receive ten (10) bonus points when completing a turn when a tile is placed on a bonus square. Moreover, if a player is able to play all five (5) tiles in a single turn, that player may be awarded a further bonus of thirty (30) points.

As described above with respect to FIG. 4, to play a game in accordance with method 100, game board 10 is first set up to include placement of numbered tiles 60, 62 and 64 from first and second sets 40, 42, (and optionally) fourth set 46. To that end, each of tiles 60, 62 and 64 in first, second and fourth sets 40, 42, 44 may be placed numbered-side down with a single tile picked randomly and placed number-side up on a respective square 18, 22, 30 using corresponding indicia. Random tiles 60, 62 and 64 are picked until all of squares 18, 22, 30 are occupied by a respective tile 60, 62, 64. Each tile 63 of third set 44 is placed numbered-side down in a draw pile adjacent game board 10. At this point, game board 10 is set up and the game is ready to be played. To that end, each player draws five (5) tiles 63 from the draw pool to create a respective player pool. The players may draw tiles 63 or otherwise select a player to go first, with each successive player then taking a turn in order, as described above.

FIG. 6 shows game board 10 as set up in FIG. 5 following a number of successive turns. By way of example, two turns are generally indicated by arrows 150, 152. As indicated, during turn 150, a player has placed tiles 44*a* (numbered 3), 44*b* (numbered 5) and 44*c* (numbered 2) such that tile 44*b* intersects fourth set tile 46*a* (numbered 5). Following the scoring system outlined above, turn 150 will total an awarded points of 49 as broken down by: two (2) sums of "10" (i.e., horizontal sum 3+5+2 and vertical sum 5+5=20 awarded points); three (3) tiles played (3 tiles times 3 points each=9 awarded points); and 20 bonus points for tile 44*b* being placed on bonus square 34*a* in both the horizontal sum (10 bonus points) and the vertical sum (10 bonus points) (compare FIG. 5). During turn 152, a subsequent play (such as by another player or the same player who conducted turn 150) also scores 39 awarded points. That is, turn 152 includes placement of tiles 44*d*, 44*e* and 44*f* (3 tiles times 3 points each=9 awarded points) to form two (2) sums of "10" (i.e. 2+2+5+1 from tiles 44*c*, 44*d*, 44*e*, and 44*f*, and 5+5 from tiles 44*e* and 46*a*, thereby resulting in 20 awarded points). Tile 44*d* is also placed on bonus square 34*b* (compare FIG. 5) thus yielding a bonus 10 awarded points for the turn total awarded points of 39. Note that whenever third set 44 of numbered tiles 38*a* are placed touching another tile, the resulting vertical or horizontal sum must equal "10", otherwise the tile placement is invalid and must be removed from the game board.

In a further aspect of the present invention, a player may choose to trade tiles or pass their respective turn. For example, a player may choose to trade tiles by selecting, such as up to three (3), tiles from their respective player pool and return these tiles to the draw pool. The player may then draw an equal number of tiles and place these tiles within their player pool for use in subsequent turns. A trading player may be assessed a penalty of minus 3 (−3) points for each tile traded. Alternatively, a player may choose to pass their turn whereby the player maintains their player pool for subsequent turns. A passing player may not be assessed any penalty for this action.

In yet another aspect of the present invention and as described above, a subset of third set 44 of the plurality of numbered tiles 38 may include wildcard indicator 56, such as but not limited to the letter "W", whereby a tile from third set 44 having wildcard indicator 56 may be designated by the player to have any selected value. By way of example, as shown in FIG. 6, a player has placed a wildcard tile 44*g* adjacent fourth set tile 46*b* (numbered 7) such that wildcard tile 44*g* is designated to value three (3). Accordingly, this turn would yield 13 awarded points (i.e., one (1) sum of "10" (10 awarded points) and 1 tile played (3 awarded points)=13 awarded points).

As described above, the game may end, for example, when: 1) all tiles 44 have been drawn from the draw pile and one player has placed all of their tiles 44 on game board 10; or 2) all players have tiles 44 remaining within their respective player pool but are unable to play a tile on game board 10. In a further aspect of the present invention, if a player is able to play all tiles after the draw pool is empty, that player may be awarded a bonus of three (3) points for each unplayed tile within the other players' respective player pools. The winner of the game may be the player having the highest cumulative total of awarded points at the end of the game.

While the above example was directed to a method of playing a board game wherein numbered tiles are arranged to sum to a predetermined value of "10", it should be understood by those skilled in the art that alternative game methods may require different sums. For example, and without limitation thereto, game playing methods employing numbered tiles bearing fractions, decimals or positive and negative integers may be directed to creating sums of "1" or "0". In another further non-limiting example, a method may employ numbered tiles bearing integers that are multiples of "5" (such as "5", "10", "20", etc.) such that players may make sums of "100", "200" or any other player-identified sum. In still a further non-limiting example, a method may employ number tiles ranging from, for instance, "−9" to "+9", whereby each player is required to make a sum equal to the number on the first numbered tile that player selects from the draw pool at the beginning of the game and after each player turn for that respective player. For example, if the first players selects a "+6" first and a second player selects a "−2" first, the first player will be required to make at least one sum of "6" while the second player will be required to make at least one sum of "−2". Each respective sum may be awarded a predetermined number of points, such as "10". Upon replacement of the played tiles (i.e., step 128 or step 134 described above), each player will then be required to make at least one sum equal to the number shown on the first replacement tile so selected.

Figure 7:
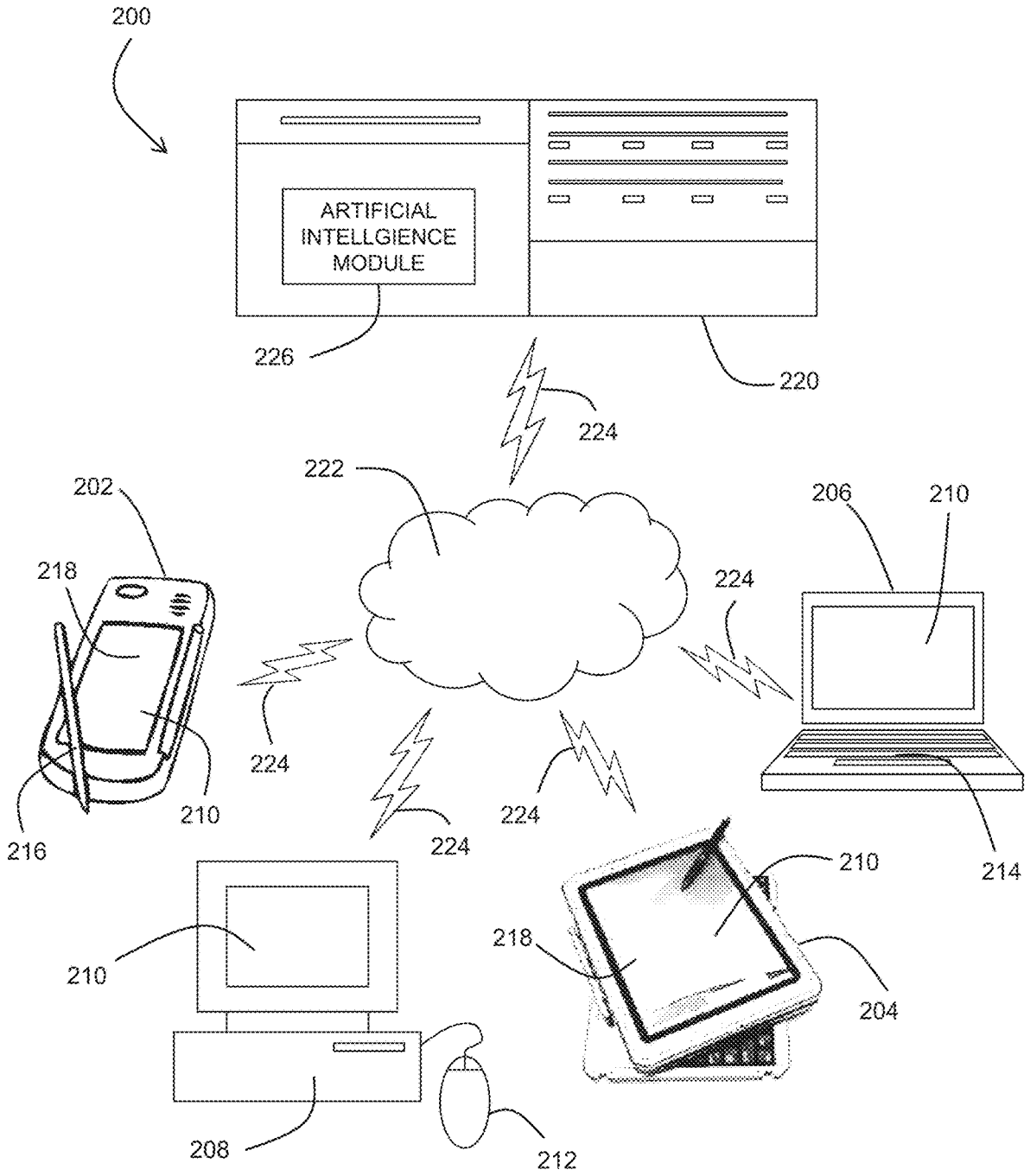
FIG. 7 is a schematic of an exemplary electronic board game that is configured to implement a method of playing a board game using a computing device in accordance with an aspect of the present invention.

It should be understood by those skilled in the art that the board game and various methods of playing the same as discussed above may be implemented in the form of a physical board game, or a computing device through the use of hardware, software, and combinations thereof. On one example, game board 10 and tiles 38 may be physical objects. In another example, as shown in FIG. 7, the board game may be a computer-based system 200 wherein game board 10 and tiles 38 may be digitally represented and manipulated on any suitable computing device, such as but not limited to a smart phone 202, tablet computer 204, laptop computer 206, desktop computer 208, and the like. To that end, such computing device may include a display 210 for displaying game board 10 and tiles 38, and one or more suitable peripheral user input devices, such as a mouse 212, keyboard 214, stylus 216 or touch screen input controller 218 so as to, for instance, select and manipulate tiles 38 during play. In accordance with a further aspect of the invention, the board game may be provided in a networked environment (e.g., Internet), wherein the method is in the form of computer readable instructions that are stored a server 220 and/or within the memory of computing device 202, 204, 206, 208. Two or more players may use their own respective computing device 202, 204, 206, 208 to access network 222 via a respective wired or wireless network connection 224 so as to play a game against each other. In this manner, two or more players may play a game while at remote locations from one another. In an alternative aspect of the present invention, server 220 may include an artificial intelligence module 226 including computer readable instructions configured to simulate a human player playing a game. In accordance with this aspect, one or more players may play a game including one or more computer-based "players" executing the artificial intelligence algorithm.

Moreover, while the above discussion shows and describes methods and systems using integers, decimals and/or fractions, it should be understood by those skilled in the art that other mathematical systems may be employed whereby players are required to sum consecutive tiles to equal a predetermined value and that such other and additional systems are to be considered within the teachings of the present invention.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A board game consisting of:

a game board arranged as a grid of a plurality of playing squares, wherein the plurality of playing squares includes a first set of playing squares having a first indicia, a second set of playing squares having a second indicia, and a third set of playing squares having a third indicia, wherein no playing square of the first set is directly adjacent to another playing square of the first set, and wherein no playing square of the second set is directly adjacent to another playing square of the second set;

a first set of numbered tiles having the first indicia, wherein only tiles of the first set of numbered tiles are only positioned on the first set of playing squares;

a second set of numbered tiles having the second indicia, wherein only tiles of the second set of numbered tiles are only positioned on the second set of playing squares; and a third set of numbered tiles having the third indicia, wherein only the third set of numbered tiles are positioned in a draw pool, wherein a predetermined number of the third set of numbered tiles are selectively removed from the draw pool and positioned in two or more player pools, wherein the third set of numbered tiles in the player pools are selectively positioned only on the third set of playing squares adjacent to at least one of the first set, the second set, or the third set of numbered tiles already positioned on the game board in at least one of a straight vertical line or a straight horizontal line including at least one of the first set, the second set, or the third set of numbered tiles already positioned on the game board, and wherein the positioned one or more numbered tiles create one or more linear sequences so that a sum of the numbers on the numbered tiles within each of the one or more linear sequences equals a predetermined value.

2. The board game in accordance with claim 1, wherein each of the numbered tiles in the first set, the second set, and the third set of numbered tiles includes an image of one of an integer, a fraction, or a decimal.

3. The board game in accordance with claim 2, wherein at least one of the numbered tiles within the first set, the second set, and the third set of numbered tiles further includes an image of a ten frame thereon.

4. A board game consisting of:

a game board arranged as a grid of a plurality of playing squares, wherein the plurality of playing squares includes a first set of playing squares having a first indicia, a second set of playing squares having a second indicia, a third set of playing squares having a third indicia, and a fourth set of playing squares having a fourth indicia, wherein no playing square of the first set is directly adjacent to another playing square of the first set, and wherein no playing square of the second set is directly adjacent to another playing square of the second set;

a first set of numbered tiles having the first indicia, wherein only tiles of the first set of numbered tiles are only positioned on the first set of playing squares;

a second set of numbered tiles having the second indicia, wherein only tiles of the second set of numbered tiles are only positioned on the second set of playing squares;

a third set of numbered tiles having the third indicia, wherein only the third set of numbered tiles are positioned in a draw pool, wherein a predetermined number of the third set of numbered tiles are selectively removed from the draw pool and positioned in two or more player pools; and a fourth set of numbered tiles having the fourth indicia, wherein only tiles of the fourth set of numbered tiles are only positioned on the fourth set of playing squares;

wherein the third set of numbered tiles in the player pools are selectively positioned only on the third set of playing squares adjacent to at least one of the first set, the second set, the third set or the fourth set of numbered tiles already placed on the game board in at least one of a straight vertical line or a straight horizontal line including at least one of the first set, the second set, the third set, or the fourth set of numbered tiles already placed on the game board, and wherein the positioned one or more numbered tiles create one or more linear sequences so that a sum of the numbers on the numbered tiles within each of the one or more linear sequences equals a predetermined value.

5. The board game in accordance with claim 4, wherein each of the numbered tiles in the first set, the second set, the third set, and the fourth set of numbered tiles includes an image of one of an integer, a fraction, or a decimal.

6. The board game in accordance with claim 5, wherein one or more of the numbered tiles in the first set, the second set, the third set, and the fourth set of numbered tiles further includes an image of a ten frame thereon.

* * * * *